US006877969B2

(12) United States Patent
Yao et al.

(10) Patent No.: US 6,877,969 B2
(45) Date of Patent: Apr. 12, 2005

(54) VANE PUMP

(75) Inventors: Hiroyuki Yao, Okazaki (JP); Hidetoshi Fujiwara, Nukata-gun (JP); Kentaro Yamauchi, Okazaki (JP)

(73) Assignee: Toyoda Koki Kabushiki Kaisha, Kariya (JP)

( * ) Notice: Subject to any disclaimer, the term of this patent is extended or adjusted under 35 U.S.C. 154(b) by 0 days.

(21) Appl. No.: 10/819,290

(22) Filed: Apr. 7, 2004

(65) Prior Publication Data

US 2004/0202565 A1 Oct. 14, 2004

(30) Foreign Application Priority Data

Apr. 9, 2003 (JP) ..... 2003-105286

(51) Int. Cl.[7] ..... F04C 18/00

(52) U.S. Cl. ..... 418/268; 418/269; 418/270; 418/133; 418/81

(58) Field of Search ..... 418/268, 269, 418/270, 133, 77, 81, 82

(56) References Cited

U.S. PATENT DOCUMENTS 4,386,891 A * 6/1983 Riefel et al. ..... 418/81
6,068,461 A * 5/2000 Haga et al. ..... 418/180
6,203,303 B1 * 3/2001 Fujiwara et al. ..... 418/268
6,244,830 B1 6/2001 Agner

FOREIGN PATENT DOCUMENTS

EP 1008753 A2 * 6/2000 ..... F04C/2/344

* cited by examiner

*Primary Examiner*—Thomas Denion
*Assistant Examiner*—Theresa Trieu
(74) *Attorney, Agent, or Firm*—Oblon, Spivak, McClelland, Maier & Neustadt, P.C.

(57) ABSTRACT

Within an angular area where each vane of a vane pump having backpressure grooves is moved radially inwardly as the rotor rotates, the outer circumferential edge of the backpressure groove is indented toward the rotational axis of the rotor along a locus drawn by the radial innermost end of each vane so that the radial innermost end of each vane does not protrude radially inwardly beyond a predetermined distance from the indented part of the outer circumferential edge of the backpressure groove.

6 Claims, 3 Drawing Sheets

VANE PUMP

INCORPORATION BY REFERENCE

This application is based on and claims priority under 35 U.S.C. sctn. 119 with respect to Japanese Application No. 2003-105286 filed on Apr. 9, 2003, the entire content of which is incorporated herein by reference.

BACKGROUND OF THE INVENTION

1. Field of the Invention

The present invention relates to a vane pump suitable for use as hydraulic pressure supply to a power steering device and in particularly, to an improvement in a vane guide arrangement for smoothening radial movements of vanes around at each of ejection ports.

2. Discussion of the Related Art

Heretofore, as a vane pump used as hydraulic oil supply to a power steering device, there has been known one described in U.S. Pat. No. 6,203,303 B1 to H. Fujiwara et al. In this known vane pump, a rotor with plural slits formed to extend radially therein is rotatably provided in a cam ring contained in a pump housing, and a plurality of vanes are slidably received respectively in the slits. A pair of side wall members are provided to close the axial opposite end portions of the cam ring. Plural arc backpressure grooves communicating with innermost end portions of the slits and plural arc communication grooves connecting the backpressure grooves one after another are engraved at an inside end surface of each side wall member on which the rotor rotationally slides, and are supplied with the pump ejection pressure. Further, a recess (or cutout) portion which does not contact the side surface of each vane is formed on at least one of rotor sliding surfaces of the side wall members.

FIG. 4 shows one side plate 1 incorporated in the aforementioned prior art vane pump. The side plate 1 corresponds to a side plate 20 used a vane pump in the embodiment whose longitudinal sectional view is shown in FIG. 1, as referred to later in detail. More specifically, the side plate 1 in the prior art vane pump has a rotor sliding inside end surface, on which there are engraved a pair of right and left suction ports 21 and a pair of upper and lower ejection ports 22. At the center of the side plate 1, an annular backpressure groove 2 is engraved to encircle a through bore 1*a* which a pump shaft for driving a rotor passes through. The backpressure groove 2 is constituted by a pair of right and left suction backpressure grooves 3 each being radially wide and taking an arc shape, a pair of upper and lower ejection backpressure grooves 4 each being radially wide and taking an arc shape, plural arc communication grooves 5 each being narrow in radial width, and a pair of cutout or recess portions 6. Each of the suction backpressure grooves 3 is arranged radially inside of a corresponding one of the suction ports 21 at an angular or circumferential position close to the same, while each of the ejection backpressure grooves 4 is arranged radially inside of a corresponding one of the ejection ports 22 at a circumferential position close to the same. Each of the communication grooves 5 makes adjoining suction and ejection backpressure grooves 3, 4 communicate with each other. Each of the recess portions 6 is provided to prevent the radially inner part of the side surface of each vane from contacting the inside end surface of the side plate 1 over an angular area where each vane rotating counterclockwise in FIG. 4 remains protruded to the radial outermost position and over another angular area where it is moved radially inwardly (i.e., the pre-compression area and compression area shown in FIG. 4 of the aforementioned United States patent). Further, a passage (not shown) is provided to make each suction backpressure groove 3 communicate with the ejection ports 22. Each recess portion 6 in the prior art technology is formed to cover an angular area which ranges from an angular position slightly leaving the rotationally preceding end of each suction backpressure groove 3 to the rotationally preceding end of each ejection backpressure groove 4. The axial depth of each recess portion 6 is the same degree as those of the communication grooves 5 and is shallower than those of the suction and ejection backpressure grooves 3, 4. The outer circumferential edge of each recess portion 6 is an arc shape which is somewhat larger in radius than the locus (L) drawn by the radially innermost end of each vane and takes its center on the center of the through bore 1*a*.

In the vane pump of the aforementioned prior art technology, the contact length of the side surface of each vane with the inside end surface of the side plate 1 is shortened by providing the recess portion 6. As a result, sliding resistance is decreased between the inside end surface of the side plate 1 and the side surface of each vane as well as between each vane and the rotor slit receiving the same. Further, an increased pressure in each ejection backpressure groove 4 which is attributed to the radially inward movement of each van is applied by way of the recess portion 6 to the radial innermost end of the vane in an angular area where the same is to be protruded to the outermost position, so that the vane can be enabled to protrude quickly from the rotor at the start of the pump operation.

In vane pumps of this type, the radial movement of each vane supported in the rotor is done with the side surface thereof being slidably guided on the inside end surface of the side plate 1 in the same manner as shown in FIGS. 1 and 2 of the accompanying drawings. In an angular area over which each ejection port 22 elongates, however, the inside end surface of the side plate 1 for slidably guiding and supporting the side surface of each vane which is radially inwardly moved by being pressed along the cam surface of the cam ring upon rotation of the rotor defines a guide area, whose radial width is almost constant and narrow, between the outer circumferential edge of each arc shape recess portion 6 and the inner circumferential edge of each arc shape ejection port 22, as indicated at "e" in FIG. 4.

As discussed above, in the prior art technology, the inside end surface of the side plate (side wall member) 1 which slidably guides the side surface of each vane in the angular area over which each ejection port elongates is the guide area (e) whose radial width is almost constant and narrow. This tends to cause each vane passing there to incline relative to the side plate 1, and thus, the side plate 1 is insufficient to guide each vane. On the other hand, the force which causes each vane rotating with the rotor to move radially inwardly within the same angular area is generated by sliding the radial outer end of each vane on the slanted cam surface at the internal surface of the cam ring against the friction force therebetween. Therefore, the force tends to involve self-induced vibration and varies irregularly in terms of time and place. In this way, as the irregularly variable force is exerted on each vane guided by the guide surface which is insufficient in the function therefor, each vane is inclined relative to the guide area (e) to scrape against the same and cannot move stably and smoothly. For this reason, there arises a problem that the cam surface at the internal surface of the cam ring is abraded notably within the aforementioned angular area, thereby generating pulsation in the pump ejection pressure as well as increasing the operation noise.

A similar problem arises in the case where the backpressure groove 2 is of the type that the recess portions 6 are omitted to constitute the backpressure groove 2 only by the suction and ejection backpressure grooves 3, 4 and the communication grooves 5. In this modified case, within the angular area over which each ejection port 22 elongates, the inside end surface of the side plate 1 which slidably guides one side surface of each vane when the same is moved radially inwardly defines a guide area whose radial width is almost constant and narrow (though somewhat wider than that on the aforementioned guide area (e)) between the outer circumferential arc edge of each ejection backpressure groove 4 and the inner circumferential arc edge of each ejection port 22. Accordingly, the similar problem results in smaller damage than that in the aforementioned case, but remains left unsolved.

In addition, the similar problem arises in the case of a further modified side plate wherein the backpressure groove 2 is formed by extending the suction backpressure grooves 3 (or the ejection backpressure grooves 4) continuously over the whole circumferential length.

SUMMARY OF THE INVENTION

Accordingly, in view of the foregoing drawbacks, it is a primary object of the present invention to provide an improved vane pump capable of enlarging a guide area for guiding each vane around at an ejection port.

Briefly, in a vane pump according to the present invention, a vane pump section is composed of a cam ring contained in a pump housing, a rotor rotatably provided in the cam ring with a plurality of slits formed in radial direction, and a plurality of vanes guided to be radially slidable respectively in the slits and brought at radial outermost ends into sliding engagement with a cam surface formed at the internal surface of the cam ring for partitioning a space between the outer circumferential surface of the rotor and the cam surface into plural pump chambers each of which is varied in volume as the rotor rotates. The vane pump further comprises at least one side wall member closing a side surface of the vane pump section and enabling the rotor and the vanes to be slidable thereon. An annular backpressure groove is formed on an inside end surface of the side wall member and encircles the rotational axis of the rotor to communicate with innermost end portions of the slits. The annular backpressure groove is supplied with pressurized fluid ejected from the pump. Within an angular area where each of the vanes is moved radially inwardly while being rotated together with the rotor, the outer circumferential edge of the backpressure groove is indented toward the rotational axis of the rotor along a locus which the radial innermost end of each vane draws so that the radial innermost end of each vane does not protrude radially inwardly beyond a predetermined distance from the outer circumferential edge of the backpressure groove.

With this configuration, within the angular area where each of the vanes is moved radially inwardly while being rotated together with the rotor, the outer circumferential edge of the backpressure groove is indented toward the rotational axis of the rotor along the locus, so that the radial innermost end of each vane is prevented from protruding radially inwardly beyond the predetermined distance from the outer circumferential edge of the backpressure groove. Thus, the radial width of a guide area on the inside end surface of the side wall member which slidably guides one side surface of each vane when the same is moved radially inwardly is enlarged by the amount indented toward the rotational axis of the rotor. Therefore, since the vane guide function of the inside end surface of the side wall member is ensured, the radially inward movement of each vane within the aforementioned angular area can be stabilized and smoothened compared to that in the prior art. Consequently, the cam surface at the internal surface of the cam ring can be prevented from suffering notable abrasion. Further, pulsation is hardly generated in the pump ejection pressure, nor does noise increase in the pump operation.

BRIEF DESCRIPTION OF THE ACCOMPANYING DRAWINGS

The foregoing and other objects and many of the attendant advantages of the present invention may readily be appreciated as the same becomes better understood by reference to the preferred embodiment of the present invention when considered in connection with the accompanying drawings, wherein like reference numerals designate the same or corresponding parts throughout several views, and in which.

DETAILED DESCRIPTION OF THE PREFERRED EMBODIMENT

Figure 1:
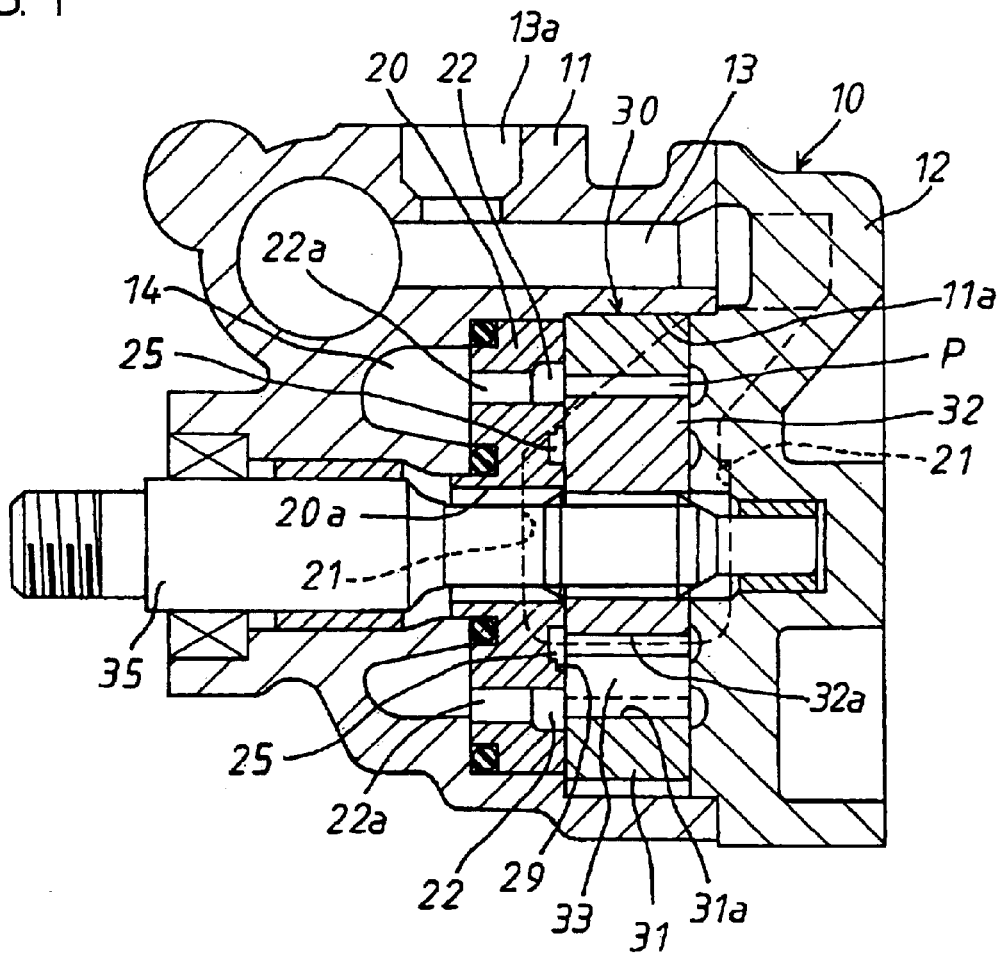
FIG. 1 is a longitudinal sectional view of a vane pump in one embodiment according to the present invention.

A vane pump in one embodiment according to the present invention will be described hereinafter with reference to FIGS. 1 through 3. The vane pump in this particular embodiment is of the type that a side plate 20 and a vane pump section 30 are piled up on each other to be stored within a pump housing 10. The pump housing 10 is composed of a front housing 11 having a stepped, cylindrical cave 11*a* therein and a rear housing 12 secured by means of bolts (not shown) to the front housing 11 to fluid-tightly cover up an opening end of the cave 11*a*. Inside the cave 11*a*, the side plate 20 and the vane pump section 30 are plied up and housed respectively at the bottom portion and the opening end portion. The axial opposite ends of the vane pump section 30 are closed with the side plate 20 and the rear housing 12 which are kept in abutting engagement therewith to constitute side wall members for the vane pump section 30. Inside the housing 10, a pump shaft 35 is also arranged coaxially with the cave 11*a* and is rotatably supported at axial opposite end portions thereof by means of bearings (not numbered), which are provided respectively in the front housing 11 and the rear housing 12.

Figure 2:
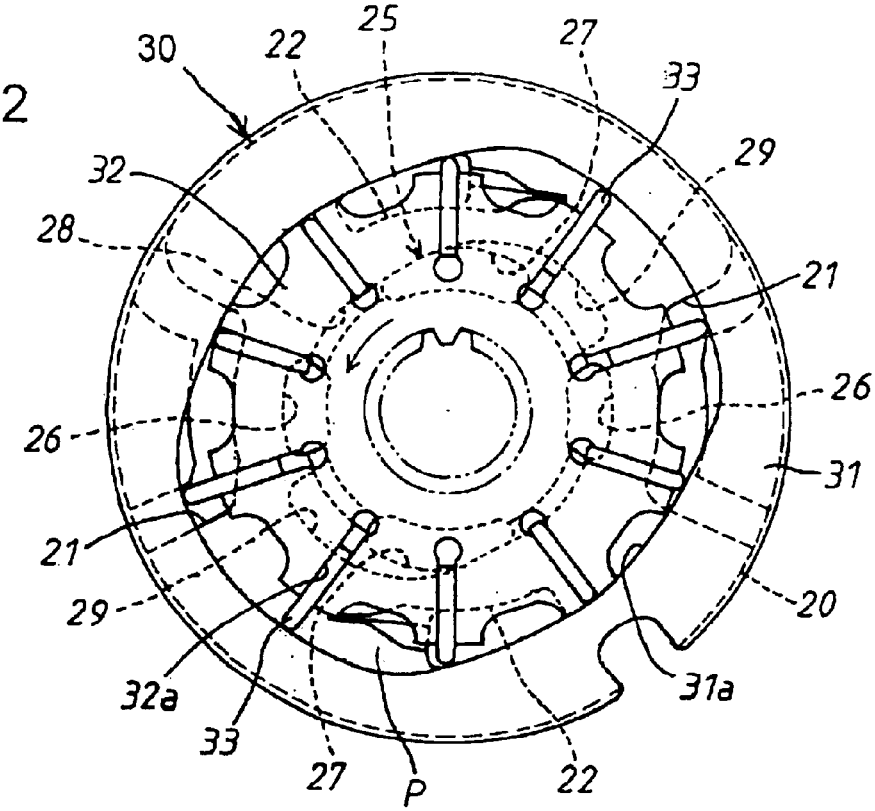
FIG. 2 is an enlarged side view of a pump section incorporated in the vane pump as viewed from the right in FIG. 1.
Figure 3:
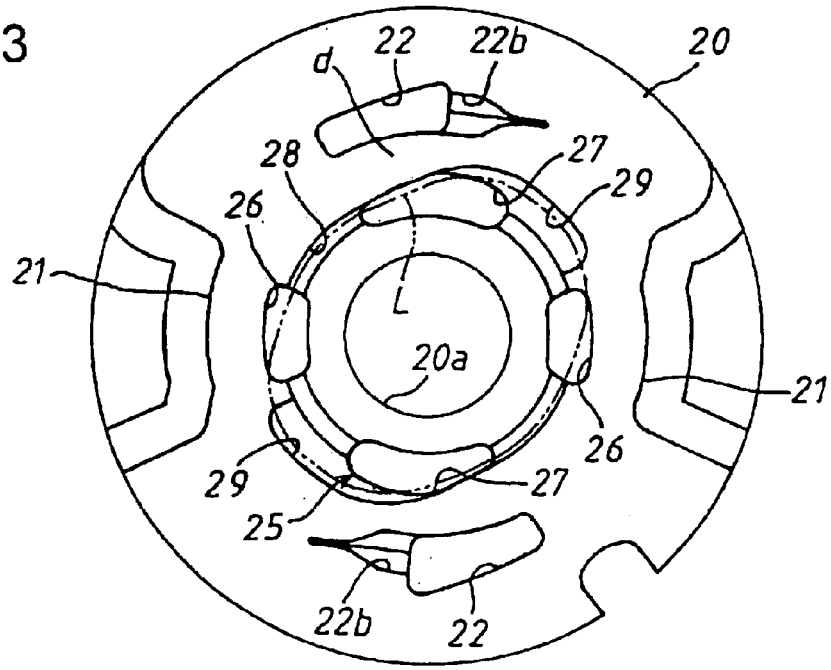
FIG. 3 is an enlarged side view of a side plate in the embodiment as viewed from the right in FIG. 1.

As best shown in FIGS. 2 and 3, the vane pump section 30 is composed of a cam ring 31 snugly fit and supported in the cave 11*a* of the front housing 11 and having a cam surface 31*a* of a generally elliptical shape at an internal surface thereof, a rotor 32 connected coaxially on the axial mid portion of the pump shaft 35 through a spline engagement and having a plurality of slits 32*a* arranged at the outer circumferential portion thereof at regular angular intervals to extend radially, and a plurality of vanes 33 respectively received in the slits 32*a* to be movable radially. The vanes 33 are brought into sliding contacts at radial outer ends thereof with the cam surface 31*a* of the cam ring 31, so that each vane 33 is radially moved to follow the cam surface 31*a* upon rotation of the rotor 32. The vanes 33 partition a space between the outer circumferential surface of the rotor 32 and the cam surface 31*a* into a plurality of pump chambers (P) each of which is varied in volume as the rotor 32 rotates. The cam ring 31, together with the side plate 20, is positioned by means of positioning pins (not shown) on the housing 10 not to be rotated relative thereto. The rotor 32 and the vanes 33 are slidable on inside end surfaces of the rear housing 12 and the side plate 20.

As best shown in FIG. 3, the side plate 20 has formed a pair of horizontally spaced suction ports 21 and another pair of vertically spaced ejection ports 22 on the inside end surface on which the vanes 33 are slidable. Further, the side plate 20 has formed an annular backpressure groove 25 at its center portion to encircle a through bore 20*a* which the pump shaft 35 passes through. Each suction port 21 is formed at the outer circumferential portion on the inside end surface of the side plate 20 to elongate circumferentially within an angular range or area (i.e., expansion area) where the vanes 33 move radially outwardly to increase the volume of each pump chamber (P) as the rotor 32 rotates. The suction ports 21 are in communication with a suction hole 13*a* through a suction passage 13 formed in the housing 10. Each ejection port 22 is formed on the inside end surface of the side plate 20 to elongate circumferentially within another angular range or area (i.e., compression area) where the vanes 33 move radially inwardly to decrease the volume of each pump chamber (P) as the rotor 32 rotates. Each ejection portion 22 is in communication with a pressure chamber 14 which is formed at the bottom end portion of the cave 11*a* located behind the side plate 20, through a passage 22*a* formed in the side pate 20 and is further in communication with an ejection bore through an ejection passage (both not shown) formed in the housing 10. Each ejection port 22 elongates in the form of an arc shape and, at a rotationally following end thereof as the rotor 32 rotates, is formed with a whisker groove 22*b* tiny in cross-section for preventing the drive torque fluctuation and the noise which are caused by the temporal increase in the pressure in the pump chambers (P).

The backpressure groove 25 is arranged to communicate with radial innermost end portions of the slits 32*a*. As shown in FIGS. 2 and 3, the groove 25 comprises a pair of right and left suction backpressure grooves 26, a pair of upper and lower ejection backpressure grooves 27, communication grooves 28, and a pair of cutout or recess portions 29. Each of the suction backpressure grooves 26 is generally arc and large in radial width and is arranged at the same angular phase as a corresponding one of the suction ports 21 and between the same and the through bore 20*a* in radial direction. Similarly, each of the ejection backpressure grooves 27 is generally arc and large in radial width and is arranged at the same angular phase as a corresponding one of the ejection ports 22 and between the same and the through bore 20*a* in radial direction. Each of the communication grooves 28 takes the shape of a slender arc and makes each suction backpressure groove 26 communicate with each ejection backpressure groove 27. Each of the recess portions 29 is arranged to cover an angular area where each vane 33 rotating with the rotor 32 is kept as being protruded to an outermost radial position, and extends radially outwardly from each ejection backpressure groove 27 and the communication groove 28 behind the same in the rotational direction of the rotor 32. That is, the angular area covers almost an pre-compression area and a compression area. Thus, as each vane 33 is moved radially in the slit 32*a* therefor, the operating oil flows between the innermost end portion of the slit 32*a* and the backpressure groove 25. The axial depth and radial width of each of the suction and ejection backpressure grooves 26, 27 are chosen to be of large values of the extent that each of the grooves 26, 27 does not have a function of throttling the flow of the operating oil. Each communication groove 28 is made narrower in radial width than those of the backpressure grooves 26, 27 and is made to be around one-fifth as deep as the backpressure grooves 26, 27 thereby to provide a throttling function against the aforementioned flow of the operating oil. The axial depth of each recess portion 29 is the same or less than the axial depth of each communication groove 28.

Next, the shapes of the ejection backpressure grooves 27 and the recess portions 29 will be described in grater detail with reference to FIGS. 2 and 3. The two-dotted chain line (L) in FIG. 3 indicates a locus on which the radial innermost end of each vane 33 moves when rotated with the rotor 32. Like the cam surface 31*a* of the cam ring 31, the locus (L) takes a generally ellipse shape whose radius decreases in the angular area (i.e., compression area) where each vane 33 is moved radially inwardly as the rotor 32 rotates and increases in the angular area (i.e., expansion area) where each vane 33 is moved radially outwardly. The inner circumferential edge of each ejection backpressure groove 27 taking an almost arc shape draws an arc with a center on the rotational axis of the pump shaft 35 as does that in the prior art vane pump shown in FIG. 4. On the other hand, the outer circumferential edge of each ejection backpressure groove 27 draws an arc with a center on the rotational axis of the pump shaft 35 within an angular area of about one-third which is behind in the rotational direction of the rotor 32, but draws a curve which is reflected along the aforementioned locus (L) slightly radial outside of the same, that is, in parallel to the aforementioned locus (L) thereby to be indented toward the rotational axis of the pump shaft 35 in another area of about the remaining two-third which precedes in the rotational direction of the rotor 32. Thus, within the compression angular area or, in particular, the rotationally preceding two-third angular area where each vane 33 is moved radially inwardly, each vane 33 is prevented from protruding the radial innermost end thereof radially inwardly beyond a predetermined distance from the outer circumferential edge of each ejection backpressure groove 27.

Further, in order to shorten the length over which each vane 33 contacts the inside end surface of the side plate 20, each of the cutout or recess portions 29 is formed to extend radially outwardly from each ejection backpressure groove 27 and each communication groove 28 behind rotationally within an angular area which begins from a position slightly ahead of the rotationally preceding end of each suction backpressure groove 26 and which ends at the rotationally preceding end portion of each ejection backpressure groove 27. At almost all the part except for a part preceding in the rotational direction of the rotor 32, the outer circumferential edge of each recess portion 29 makes an arc which has a radius slightly larger than the long radius of the locus (L) with respect to a center on the rotational axis of the pump shaft 35. At the part preceding in the rotational direction of the rotor 32, however, the outer circumferential edge of each recess portion 29 extends in parallel to the locus (L) which the radial innermost end of each vane 32 draws and slightly outside of the locus (L) thereby to be indented toward the rotational axis of the pump shaft 35. Thus, the radial innermost end of each vane 33, when the same is moved radially inwardly, is prevented from protruding radially inwardly beyond the predetermined distance from the outer circumferential edge of each recess portion 29 and is smoothly connected to the outer circumferential edge of each ejection backpressure groove 27 within the almost two-third angular area ahead in the rotational direction of the rotor 32.

The radius of the outer circumferential edge of each recess portion 29 is so chosen that a reliable sealing capability is secured on a part of the flat inside end surface of the side plate 20 which part is left between the recess portion 29 and the whisker groove 22*b* of the ejection port 22 for sliding contact with the side surface of the rotor 32. Further, the foregoing predetermined distance corresponds to the amount through which each vane 33 is indented radially inwardly from the outer circumferential edge of each recess portion 29 at the part behind in the rotational direction of the rotor 32 and from the outer circumferential edge of each ejection backpressure groove 27 at the part ahead in the rotational direction of the rotor 32. The predetermined distance is chosen so that a value which is necessary and sufficient to perform the function of guiding and supporting the vanes 3 is secured as the radial width of an guide area (d) which is formed on the inside surface of the side plate 20 between the rotationally preceding and radially indented part, which is common to the outer circumferential edges of each ejection backpressure groove 27 and each recess portion 29, and the inner circumferential edge of each ejection port 22 for guiding the side surface of each vane 33.

The rear housing 12 closes the side surface of the vane pump section 30 at the opposite side of the side plate 20. Primarily for pressure balance, a pair of suction ports, a pair of ejection ports and a backpressure groove which is composed of suction and ejection backpressure grooves, communication grooves and recess portions are formed on an inside end surface of the rear housing 12 in the same manner as, and symmetrically of, those formed on the inside end surface of the side plate 20. A guide area corresponding to that indicated at (d) on the side plate 20 is formed on the inside end surface of the rear housing 12 between each ejection backpressure groove and each ejection port. The suction ports formed on the rear housing 12 communicate With the suction passage 13, while the ejection ports and the backpressure groove formed on the rear housing 12 do not communicate with the exterior of the housing 11.

(Operation)

The operation of the embodiment as constructed above will be described hereinafter. Since the side plate 20 and the rear housing 12 have substantially the same functions in guiding the end surfaces of the rotor 32 and the vanes 33, the following description concerning the operation of the embodiment will be referred mainly to the side plate 20 unless particularly referred to on the contrary.

When the rotor 32 is rotated bodily with the pump shaft 35, the vane 33 guided in each slit 32*a* is reciprocated radially as the radial outmost end thereof is slidden along the cam surface 31*a* of the cam ring 31. Within the expansion angular area where each vane 33 is moved radially outwardly, the operating oil flown from the suction hole 13*a* is sucked from the suction ports 21 into each pump chamber (P) whose volume is increasing. Within the compression angular area where each vane 33 is moved radially inwardly, the operating oil within each pump chamber (P) whose volume is decreasing is ejected from each of the ejection ports 22 through the ejection passage (not shown) to a suitable fluid-operated actuator, such as for example an automotive power steering device. The force by which each vane 33 rotating with the rotor 32 is urged to move radially inwardly is generated as a result that the radial outermost end of each vane 33 protruding from the rotor 32 is slidden on each slanted part of the cam surface 31*a* at the internal surface of the cam ring 31 against the friction force and therefore irregularly fluctuates in terms of time and place because it is likely to be accompanied by self-induced vibration. However, in this particular embodiment, each of the guide areas (d) at diametrically opposite sides is formed on the inside end surface of each of the side plate 20 and the rear housing 12 between each ejection port 22 and each ejection backpressure groove 27 and the associated recess portion 29 thereby to guide and support the side surface of each vane 33. And, each guide area (d) is chosen to have the radial width which is necessary and sufficient to perform the function of guiding and supporting each vane 33. This can be done by directing or deflecting the rotationally preceding part common to the outer circumferential edges of each ejection backpressure groove 27 and the associated recess portion 29 toward the rotational axis of the rotor 32 to be indented along or in parallel to the locus (L) which each vane 33 draws at its radial innermost end. Thus, each vane 33 does not tend to incline on the guide areas (d). Accordingly, even if the force that urges each vane 33 to move radially inwardly is that which irregularly fluctuates in terms of time and place, it does not occur that each vane 33 is inclined on each guide area (d) to scrape against the same. This ensures that each vane 33 moves smoothly and stably, so that the cam ring 31 does not suffer notable abrasion at the cam surface 31*a*. Further, pulsation is hardly generated in the pump ejected pressure, nor does noise increase in the pump operation.

Figure 4:
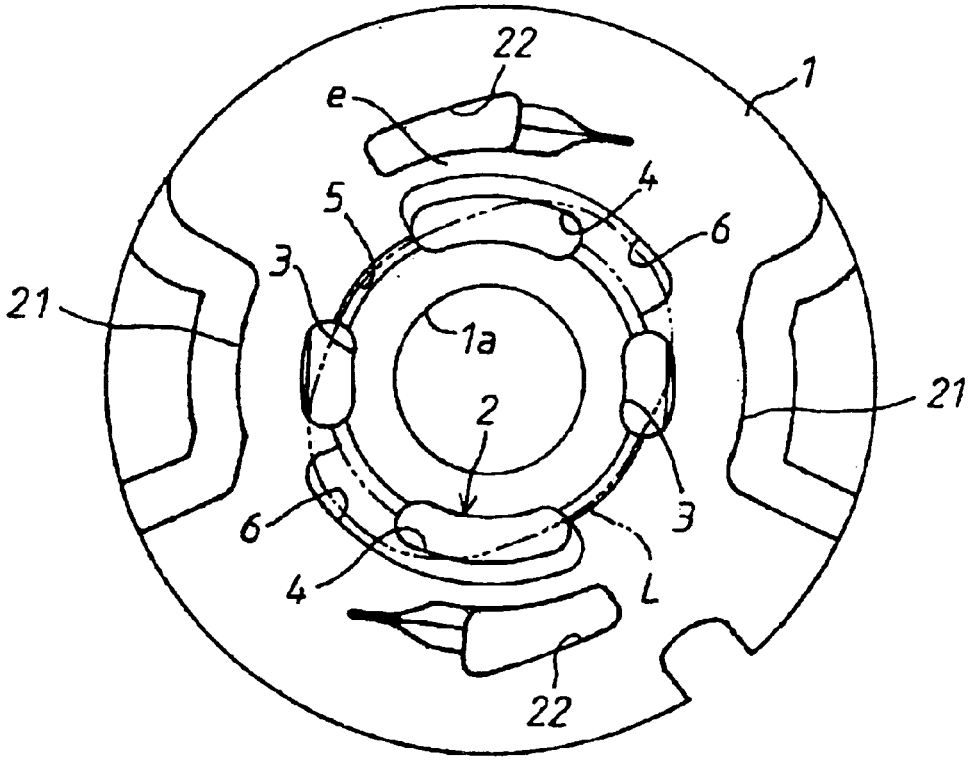
FIG. 4 PRIOR ART
FIG. 4 is an enlarged side view of another side plate used in a prior art corresponding to that shown in FIG. 3.

In the foregoing embodiment, the present invention is applied to the vane pump of the type that the backpressure groove 25 is provided with the recess portions 29 for enabling the vanes 33 to protrude quickly form the circumferential surface of the rotor 32 at the operation start of the pump. In this case, the advantage is particularly notable because the radial width of the guide area (d) which is formed between each ejection port 22 and the ejection backpressure groove 27 and the associated recess portion 29 is largely increased compared with that in the prior art vane pump wherein as shown in FIG. 4, the rotationally preceding part of the outer circumferential edge of each such recess portion 6 is not directed or deflected to be indented toward the rotor rotational axis in parallel to the locus (L) which is followed by the innermost end of each vane.

However, the application of the present invention is not limited to the vane pump with such recess portions 29. Rather, the present invention may be applied to a modified vane pump that is constituted by omitting the recess portions 6 from the prior art vane pump whose side plate 1 is shown in FIG. 4. In this modified vane pump, by deflecting the rotationally preceding part of the outer circumferential edge of each ejection backpressure groove 27 to be indented toward the rotor rotational axis in parallel to the locus (L) drawn by the radial innermost end of each vane 33 in the same manner as the foregoing embodiment, the radial width which is formed between the ejection port 22 and the ejection backpressure groove 27 can be enlarged compared to that (e) of the prior art pump wherein as shown in FIG. 4, the rotationally preceding part of the outer circumferential edge of each ejection backpressure groove 4 is not indented toward the rotor rotational axis. Thus, the movement of each vane 33 in the modified vane pump is smoothened and stabled, so that substantially the same effect as in the foregoing embodiment can be attained even in the modified vane pump.

In addition, the present invention may be applied to a further modified vane pump wherein the backpressure groove 25 is constituted to have the same cross-section as the suction backpressure grooves 26 (or the ejection backpressure grooves 27) over the entire circumferential length thereof. In this further modified vane pump, a part of the backpressure groove 25 within an angular area corresponding to each ejection port 22 is deflected to be indented toward the rotor rotational axis along or in parallel to the aforementioned locus (L). Thus, the further modified vane pump can have an enlarged radial width at the guide area which is formed between each ejection port 22 and the radially inwardly indented part of the backpressure groove, and the movement of each vane 33 becomes stable to attain substantially the same effect as is attained in the foregoing embodiment.

Although in the illustrated embodiment, the outer circumferential edges of each ejection backpressure groove 27 and the associated recess portion 29 define a single, common rotationally preceding part thereof which is deflected to be indented toward the rotor rotational axis along or in parallel to the aforementioned locus (L), they may define individual rotationally preceding parts thereof each of which is deflected to be indented toward the rotor rotational axis along or in parallel to the aforementioned locus (L), Moreover, the rotationally preceding part along the aforementioned locus (L) of each ejection backpressure groove 27 in the illustrated embodiment or of the backpressure groove 25 in the further modified embodiment may extend in parallel to the aforementioned locus (L) slightly radial outside of the same as shown in FIG. 3 or may strictly follow the aforementioned locus (L) to trace the same. The same is true with the rotationally preceding part along the aforementioned locus (L) of each recess portion 29.

Furthermore, the part indented along the aforementioned locus (L) of each ejection backpressure groove 27, of the backpressure groove 25 or of each recess portion 29 may be formed on the inside end surface of any one of the side plate 20 and the rear housing 12, but not on the inside end surface of the other.

Finally, various features and many of the attendant advantages in the foregoing embodiment will be summarized as follows:

In one aspect of the forgoing embodiment, as typically shown in FIG. 1, within the angular area where each of the vanes 33 is moved radially inwardly while being rotated together with the rotor 32, the outer circumferential edge of the backpressure groove 25 is deflected to be indented toward the rotational axis of the rotor 32 along the locus (L) so that the radial innermost end of each vane 33 is prevented from protruding radially inwardly beyond the predetermined distance from the outer circumferential edge of the backpressure groove 25. Thus, the radial width of a guide area (d) on the inside end surface of a side wall member 20 (or 12) which slidably guides one side surface of each vane 33 when the same is moved radially is enlarged by the portion indented toward the rotational axis of the rotor 32. Therefore, since the vane guide function of the inside end surface of the side wall member 20 (or 12) is ensured, the radially inward movement of each vane 33 within the aforementioned angular area can be stabilized and smoothened compared to that in the prior art. Consequently, the cam surface 31*a* at the internal surface of the cam ring 31 does not suffer notable abrasion, and pulsation is hardly generated in the pump ejection pressure, nor does noise increase in the pump operation.

In another aspect of the forgoing embodiment, the backpressure groove 25 is composed of the suction backpressure groove 26 within each expansion angular area, the ejection backpressure groove 27 within each compression angular area and the communication grooves 28 connecting the suction and ejection backpressure grooves 26, 27 for a complete circle as the backpressure groove 25. In this modified vane pump, the outer circumferential edge of the ejection backpressure groove 27 is deflected at a rotationally preceding part thereof to be indented toward the rotational axis of the rotor 32 along the locus (L) so that the radial innermost end of each vane 33 being moved radially inwardly is prevented from protruding radially inwardly beyond the predetermined distance from the outer circumferential edge of the ejection backpressure groove 27. Thus, the radial width of each guide area (d) on the inside end surface of the side wall member 20 (or 12) which slidably guides one side surface of each vane 33 when the same is moved radially is enlarged by the area which is indented toward the rotational axis of the rotor 32. Therefore, since the vane guide function of the inside end surface of the side wall member 20 (or 12) is ensured, the radially inward movement of each vane 33 within the aforementioned angular area can be stabilized and smoothened compared to that in the prior art. Consequently, the cam surface 31*a* at the internal surface of the cam ring 31 does not suffer notable abrasion, and pulsation is hardly generated in the pump ejection pressure, nor does noise increase in the pump operation.

In a further aspect of the forgoing embodiment, within at least a part of another angular area where each vane 33 is moved radially inwardly from the radial outermost position, the recess portion 29 for preventing the radial innermost part of the side end surface of each vane 33 from contacting the inside end surface of the side wall member 20 (or 12) is further provided on the inside end surface of the side wall member 20 (or 12) which slidably contact the rotor 32 and each vane 33. As a result, the length that the side surface of each vane 33 contacts the inside end surface of the side wall member 20 (or 12) is further shortened, and this reduces the sliding resistance against each vane 33, so that the same can be enabled to protrude quickly from the rotor 32 at the operation start of the vane pump. In addition, the outer circumferential edge of the recess portion 29 is deflected at its rotationally preceding part to be indented toward the rotational axis of the rotor 32 along the locus (L) so that the radial innermost end of each vane 33 does not protrude radially inwardly beyond the predetermined distance from the outer circumferential edge of the recess portion 29. Thus, the radial width of the guide area (d) on the inside end surface of the side wall member 20 (or 12) which slidably guides one side surface of each vane 33 when the same is moved radially is enlarged by the portion indented toward the rotational axis of the rotor 32. Therefore, although the contact length of the vane side surface with the inside end surface of the side wall member 20 (or 12) is shortened by the provision of the recess portion 29, the radially inward movement of each vane 33 within the aforementioned angular area can be stabilized and smoothened compared to that in the prior art since the vane guide function of the inside end surface of the side wall member 20 (or 12) is ensured. Consequently, the cam surface 31*a* at the internal surface of the cam ring 31 does not suffer notable abrasion, and pulsation is hardly generated in the pump ejection pressure, nor does noise increase in the pump operation.

Obviously, numerous modifications and variations of the present invention are possible in light of the above teachings. It is therefore to be understood that within the scope of the appended claims, the present invention may be practiced otherwise than as specifically described herein.

What is claimed is:

1. A vane pump comprising:

a vane pump section composed of a cam ring contained in a pump housing, a rotor rotatably provided in said cain ring with a plurality of slits formed in radial direction, and a plurality of vanes guided to be radially slidable respectively in said slits and brought at radial outermost ends into sliding engagement with a cam surface formed at the internal surface of said cam ring for partitioning a space between the outer circumferential surface of said rotor and said cam surface into plural pump chambers each of which is varied in volume as said rotor rotates;

at least one side wall member closing at least one side surface of said vane pump section and enabling said rotor and said vanes to be slidable thereon; and an annular backpressure groove formed on an inside end surface of said side wall member to encircle the rotational axis of said rotor to communicate with innermost end portions of said slits and supplied with pressurized fluid ejected from said pump, wherein within an angular area where each vane is moved radially inwardly while being rotated together with said rotor, the outer circumferential edge of said backpressure groove is deflected to be indented toward the rotational axis of said rotor along a locus on which the radial innermost end of each vane moves so that the radial innermost end of each vane does not protrude radially inwardly beyond a predetermined distance from the indented part of the outer circumferential edge of said backpressure groove, wherein within at least a part of another angular area where each vane is moved radially inwardly from the radial outermost position, a recess portion for preventing a radial innermost part of one side surface of each vane from contacting the inside end surface of said side wall member is further provided on the inside end surface of said side wall member which slidably contacts said rotor and each vane; and the outer circumferential edge of said recess portion is deflected at its rotationally preceding part to be indented toward the rotational axis of said rotor along said locus so that the radial innermost end of each vane does not protrude radially inwardly beyond a predetermined distance from the rotationally preceding part of the outer circumferential edge of said recess portion.

2. The vane pump as set forth in claim 1, wherein said backpressure groove comprising:

at least one suction backpressure groove arranged to be circumferentially close to at least one suction port which opens to said pump chambers within an angular area where each of said pump chambers increases its volume as said rotor rotates;

at least one ejection backpressure groove arranged to be circumferentially close to at least one ejection port which opens to said pump chambers within another angular area where each of said pump chambers decreases its volume as said rotor rotates; and communication grooves of an arc shape having a center on the rotational axis of said rotor and connecting said at least one suction backpressure groove with said at least one ejection backpressure groove; and wherein the outer circumferential edge of said ejection backpressure groove is deflected at its rotationally preceding part to be indented toward the rotational axis of said rotor along said locus so that the radial innermost end of each vane does not protrude radially inwardly beyond said predetermined distance from the rotationally preceding part of the outer circumferential edge of said ejection backpressure groove.

3. The vane pump as set forth in claim 2, wherein the rotationally preceding part of the outer circumferential edge of said ejection backpressure groove is in parallel to said locus.

4. The vane pump as set forth in claim 1, wherein the rotationally preceding part of the outer circumferential edge of said recess portion is in parallel to said locus.

5. A vane pump comprising:

a vane pump section composed of a cam ring contained in a pump housing, a rotor rotatably provided in said cam ring with a plurality of slits formed in radial direction, and a plurality of vanes guided to be radially slidable respectively in said slits and brought at radial outermost ends into sliding engagement with a cam surface formed at the internal surface of said cam ring for partitioning a space between the outer circumferential surface of said rotor and said cam surface into plural pump chambers each of which is varied in volume as said rotor rotates;

at least one side wall member closing at least one side surface of said vane pump section and enabling said rotor and said vanes to be slidable thereon; and an annular backpressure groove formed on an inside end surface of said side wall member to encircle the rotational axis of said rotor to communicate with innermost end portions of said slits and supplied with pressurized fluid ejected from said pump, wherein within an angular area where each vane is moved radially inwardly while being rotated together with said rotor, the outer circumferential edge of said backpressure groove is deflected to be indented toward the rotational axis of said rotor along a locus on which the radial innermost end of each vane moves so that the radial innermost end of each vane does not protrude radially inwardly beyond a predetermined distance from the indented part of the outer circumferential edge of said backpressure groove, wherein said backpressure groove comprises at least one suction backpressure groove arranged to be circumferentially close to at least one suction port which opens to said pump chambers within an angular area where each of said pump chambers increases its volume as said rotor rotates; at least one ejection backpressure groove arranged to be circumferentially close to at least one ejection port which opens to said pump chambers within another angular area where each of said pump chambers decreases its volume as said rotor rotates; and communication grooves of an arc shape having a center on the rotational axis of said rotor and connecting said at least one suction backpressure groove with said at least one ejection backpressure groove; and wherein the outer circumferential edge of said ejection backpressure groove is deflected at its rotationally preceding part to be indented toward the rotational axis of said rotor along said locus so that the radial innermost end of each vane does not protrude radially inwardly beyond said predetermined distance from the rotationally preceding part of the outer circumferential edge of said ejection backpressure groove, wherein: within at least a part of another angular area where each vane is moved radially inwardly from the radial outermost position, a recess portion for preventing a radial innermost part of one side surface of each vane from contacting the inside end surface of said side wall member is further provided on the inside end surface of said side wall member which slidably contacts said rotor and each vane; and the outer circumferential edge of said recess portion is deflected at its rotationally preceding part to be indented toward the rotational axis of said rotor along said locus so that the radial innermost end of each vane does not protrude radially inwardly beyond a predetermined distance from the rotationally preceding part of the outer circumferential edge of said recess portion.

6. The vane pump as set forth in claim 5, wherein the rotationally preceding part of the outer circumferential edge of said recess portion is in parallel to said locus.

* * * * *